United States Patent [19]

Fujikawa et al.

[11] 4,382,426

[45] May 10, 1983

[54] COOLING SYSTEM IN A LIQUID COOLED INTERNAL COMBUSTION ENGINE

[75] Inventors: Tetsuzo Fujikawa, Kobe; Ryoji Uda, Kakogawa; Hitoshi Yamamoto, Hyogo, all of Japan

[73] Assignee: Kawasaki Jukogyo Kabushiki Kaisha, Kobe, Japan

[21] Appl. No.: 199,400

[22] Filed: Oct. 21, 1980

[30] Foreign Application Priority Data

Oct. 22, 1979 [JP] Japan ..... 54-146697[U]

[51] Int. Cl.[3] ..... F01P 7/16

[52] U.S. Cl. ..... 123/41.1; 123/41.72

[58] Field of Search ..... 123/41.08, 41.09, 41.1, 123/41.44, 41.72, 41.82 R, 41.83, 41.84

[56] References Cited

U.S. PATENT DOCUMENTS

| | | | |
|---|---|---|---|
| 1,791,572 | 2/1931 | Ornberg | 123/41.1 |
| 2,914,045 | 11/1959 | Hill | 123/41.72 |
| 3,528,397 | 9/1970 | Seifert | 123/41.72 X |

*Primary Examiner*—William A. Cuchlinski, Jr.
*Attorney, Agent, or Firm*—Jordan and Hamburg

[57] ABSTRACT

A by-pass canal of a cooling system in an internal combustion engine for bypassing a cooling liquid between a thermostat and a liquid pump in a shortcircuit. The by-pass canal is formed in a cylinder, and a cylinder head of the engine or formed in a cylinder, a cylinder head and a crank case of the engine without extending outside of the engine.

1 Claim, 10 Drawing Figures

COOLING SYSTEM IN A LIQUID COOLED INTERNAL COMBUSTION ENGINE

SUMMARY OF THE INVENTION

The present invention relates to a liquid-cooled internal combustion engine, and more particularly it is concerned with a by-pass circuit of a cooling system.

In the cooling system of the liquid-cooled internal combustion engine a by-pass circuit is provided for preventing super cooling of a cooling liquid.

The by-pass circuit in the prior art has been provided with a rubber hose separately formed from an engine body and connected with a thermostat and a liquid pump for forming a short circuit. The by-pass circuit of the prior art has been formed as a separate part, so that it is difficult to avoid positively the leak of the liquid from the connecting part. And the piping of the prior art has been troublesome and injured the appearance of the engine body.

An object of this invention is to provide a by-pass circuit which is free from the aforesaid disadvantages of the prior art.

This invention provides a cooling system having a by-pass circuit constructed in the engine body in one body.

DETAILED DESCRIPTION OF THE PREFERRED EMBODIMENT

At first the prior art will be explained by referring to the accompanying drawings.

Figure 1:
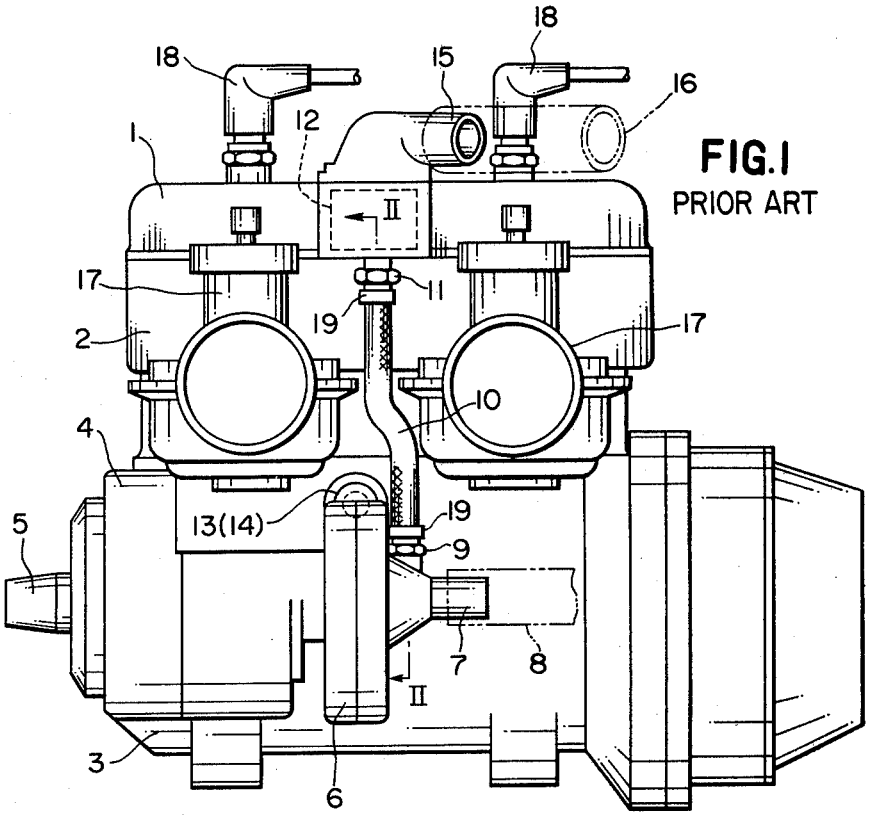
FIG.1 PRIOR ART
FIG. 1 is a left side sectional view of the internal combustion engine having the by-pass circuit of the prior art.
Figure 2:
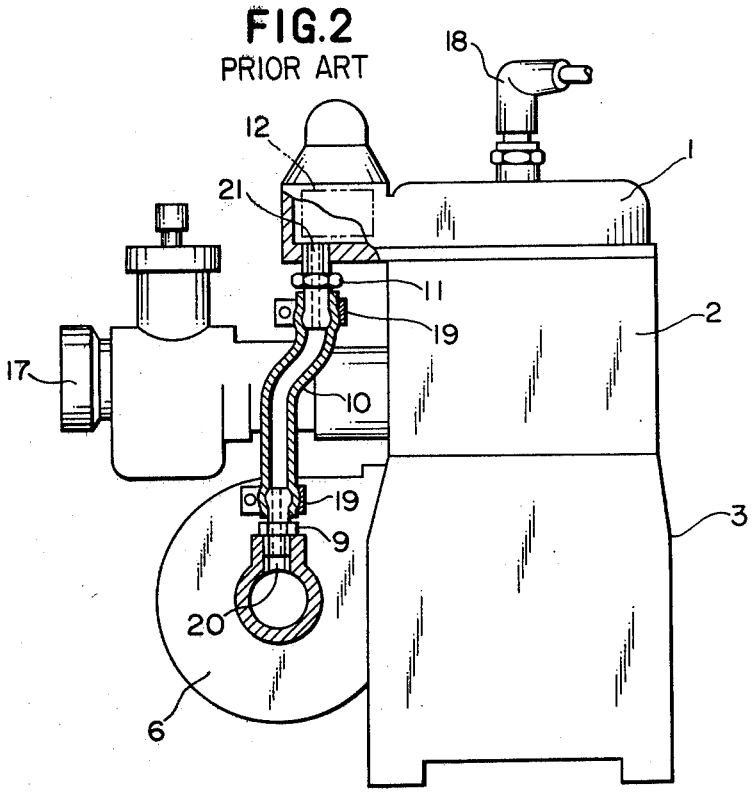
FIG.2 PRIOR ART
FIG. 2 is a schematic rear view of the engine in FIG. 1 in which the by-pass circuit is shown in a sectional view taken along a line II—II in FIG. 1.

In FIGS. 1-4 a by-pass circuit is formed with a hose connecting between a thermostat and a liquid pump. In FIG. 1 a cylinder head 1, a cylinder case 2 and a crank case 3 are connected with each other in one piece and provide an internal combustion engine body. A gear case 4 is mounted on a side wall of the crank case 3. A gear rotatably supported in the crank case (not shown in the drawing) engages with a gear supported on a crank shaft 5 and transmit a rotary motion to an impeller in a liquid pump 6 connected to the gear case 4. An inlet 7 of the liquid pump 6 is connected with an outlet of a radiator R (FIG. 5) through a rubber hose 8. A by-pass joint 9 disposed nearer to the suction impeller than to the inlet 7 of the pump is connected with a thermostat at an inlet thereof for the by-pass through a by-pass hose 10 and a by-pass joint 11. 13 designates an outlet of the liquid pump 6 and the outlet is connected with a cooling water canal 14 at a connecting portion between the liquid pump 6 and the crank case 3. The cooling liquid canal 14 is connected with a jacket (cooling liquid canal) in the cylinder case 2 at another side of the crank case 3. An outlet 15 of the thermostat 12 is connected with the inlet of the radiator through a rubber hose 16. 17 designates a carbureter, 18 designates an ignition plug and 19 designates a clamp ring. In FIG. 2 20 designates a liquid outlet of by-pass circuit, and 21 designates a liquid inlet of the by-pass circuit.

When the temperature of the cooling liquid is lower than the predetermined temperature as in warming up just after the starting and so on the canal between the liquid jacket in the cylinder head 1 and the outlet 15 is shut off by the thermostat 12. The liquid flows therefore from the outlet 13 of the liquid pump to the inlet thereof through the cylinder case 2, the cylinder-head 1 and the by-pass hose 10 and does not flow through the radiator. The cooling liquid is pressed in the pump and recirculated from the outlet 13 to the cylinder case 2 and cylinder head 1 and the temperature of the liquid is raised rapidly. When the temperature of the cooling liquid rises over the predetermined temperature the thermostat is opened and the cooling liquid in the cylinder head 1 is fed to the radiator through the outlet 15 of the thermostat and the rubber hose 16. The cooling liquid is cooled in the radiator and then returned to the liquid pump 6 through the rubber hose 8 and the inlet 7. The liquid pressed in the pump 6 is fed to the cylinder head 1 through the outlet 13 and the cylinder case 2.

Figure 3:
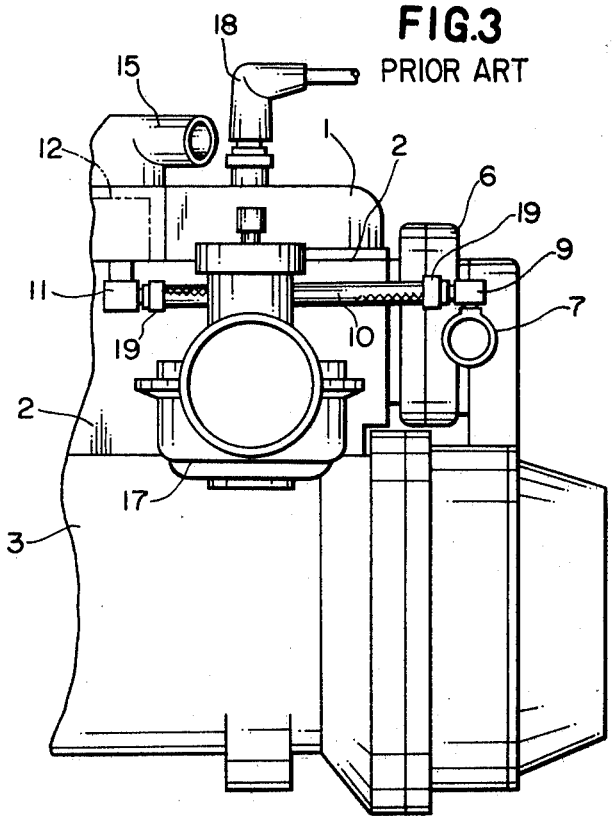
FIG.3 PRIOR ART
FIG. 3 is a left side sectional view of the embodiment of the prior art.
Figure 4:
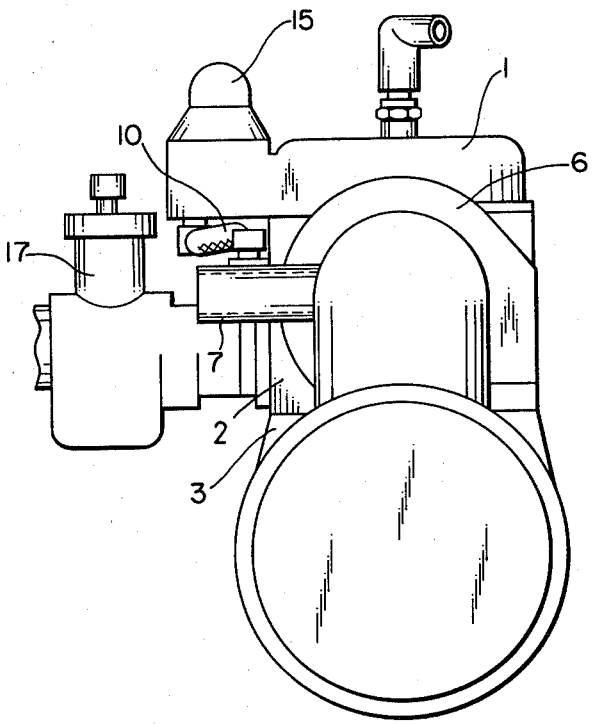
FIG.4 PRIOR ART
FIG. 4 is a schematic rear view of the embodiment shown in FIG. 3.

In FIGS. 3 and 4 another embodiment of the prior art is illustrated. In these figures identical reference numerals are utilized to refer to like elements in FIGS. 1 and 2, the liquid pump 6 is mounted to the cylinder case 2 and the by-pass hose 10 is elongated in a space between the carbureter 17 and the cylinder case 2 in substantially horizontal.

In the prior art the by-pass canal connecting between the thermostat and the liquid pump for shortcircuiting has been formed with a by-pass hose 10 in separate form. Therefore the following disadvantages can be cited. (1) The piping of the rubber hose is complicated. (2) At the connecting portion of the rubber hose the leak cannot be prevented positively. (3) A large number of parts has been required and the by-pass circuit of the prior art has been expensive. (4) The rubber hose has been disposed outside of the engine body, so that the feature is injured.

The present invention dissolves the above mentioned disadvantages by providing the by-pass canal in the cylinderhead and the cylinder case in one body or in the cylinder head, the cylinder case and the crank case in one body.

Figure 5:
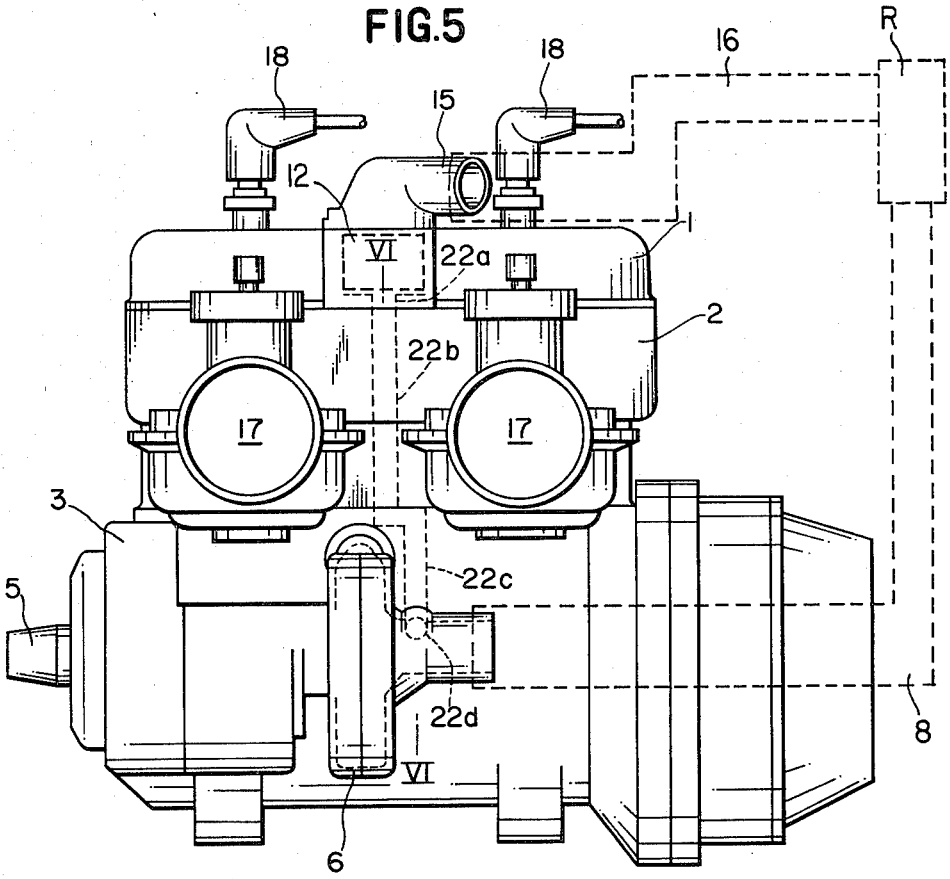
FIG. 5 is a schematic left side view of the internal combustion engine according to the present invention.
Figure 6:
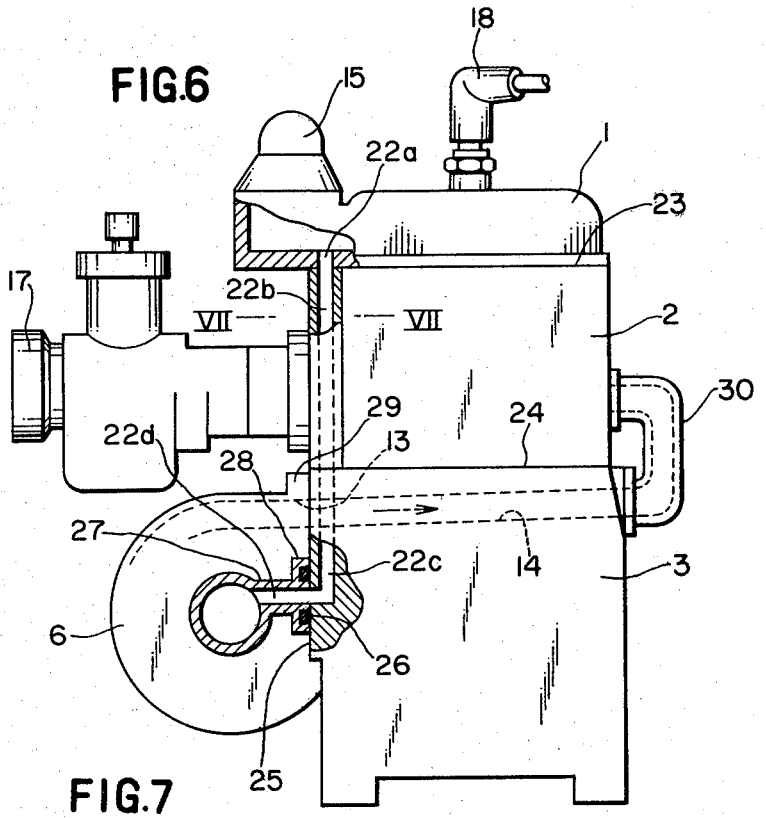
FIG. 6 is a rear view of the engine shown in FIG. 5 with partial fragmentary section taken along a line VI—VI.
Figure 7:
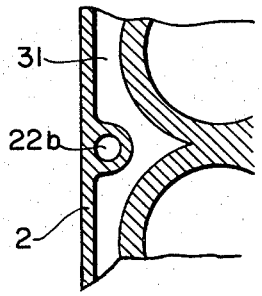
FIG. 7 is a sectional view taken along a line VII—VII in FIG. 6.

One embodiment of the present invention is illustrated in FIGS. 5 to 7. In FIG. 6 a by-pass canal **22*a* formed in the cylinder head 1 is connected in liquid-tight with a by-pass canal 22*b* formed in the cylinder case 2 in a joining plane between the cylinder head 1, and the cylinder case 2, and the by-pass canal 22*b* is connected in similar manner with a by-pass canal 22*c* in the crank case 3 in a joining plane between the cylinder case 2 and the crank case 3. The by-pass canal 22*c* is connected in liquid-tight with a by-pass canal 22***d* in the liquid pump by using O-ring 26 in a fitting plane of the crank case 3 for the liquid pump 6. The by-pass canal 22*d* is formed in a cylindrical part being formed in one body with a casing of the liquid pump 6. A flange 28 formed at one end of the cylindrical part 27 is screwed to the common fitting plane 25 of the crank case together with a flange 29 of an outlet 13. The O-ring 26 is inserted in an annular groove formed in the flange 28. 30 designates a connecting pipe. The connecting pipe connects the cooling liquid canal 14 in the crank case 3 with a cooling canal 31 in the cylinder case 2 (FIG. 7). The by-pass canals 22*a*, 22*b* and 22*c* in FIG. 6 are formed in one canal simultaneously by securing the cylinder head 1, cylinder case 2 and crank case 3 each other with a plurality of bolts. The by-pass canals 22*c* and 22*d* are connected with each other by securing the liquid pump 6 to the fitting plane 25 of the crank case with a plurality of bolts. The flow direction of the cooling liquid is similar to that of the prior art. When the temperature of the cooling liquid is lower than the predetermined temperature, the cooling liquid in the cylinder head 1 by-passes to the liquid pump 6 through the by-pass canals 22*a* to 22*d* and the flow of the cooling liquid in the cylinder head 1 is changed to the circuit through the radiator R by rising of the liquid temperature over the predetermined temperature.

Figure 8:
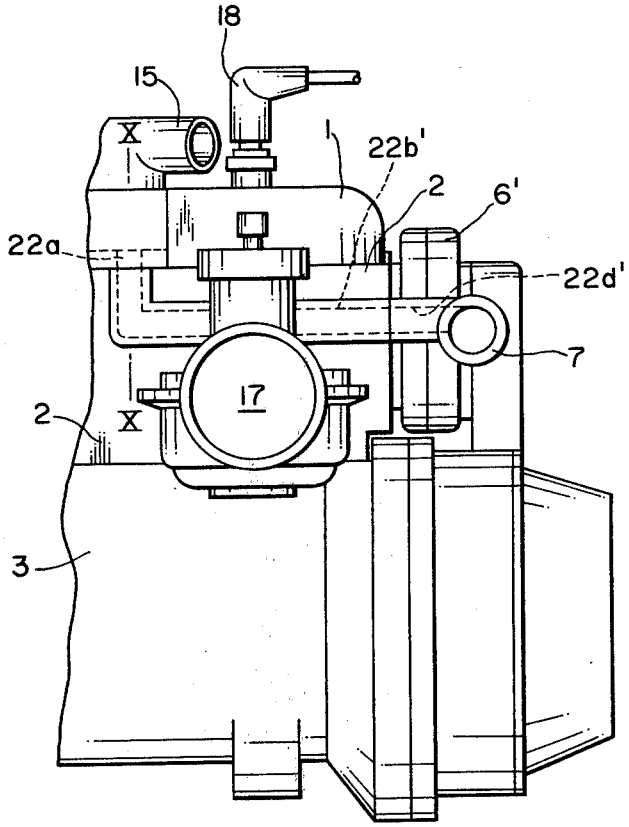
FIG. 8 is a partial side view of the second embodiment of the present invention.
Figure 9:
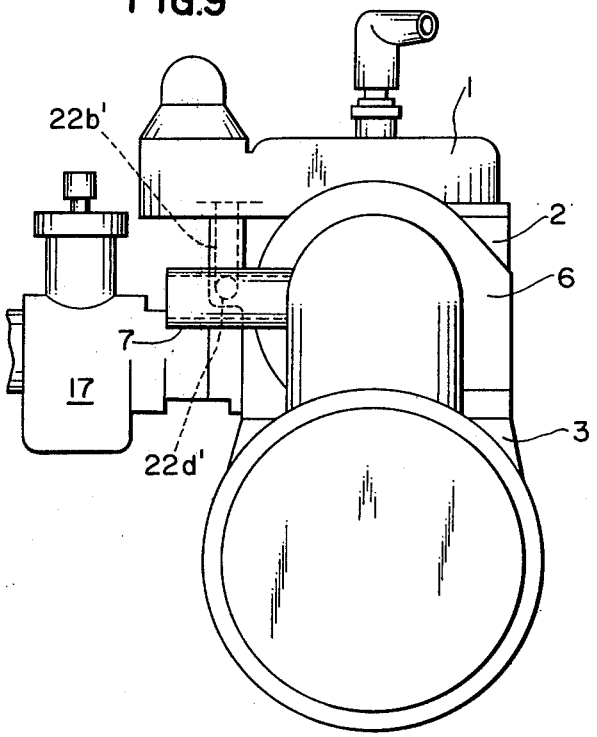
FIG. 9 is a rear view of the embodiment shown in FIG. 8.
Figure 10:
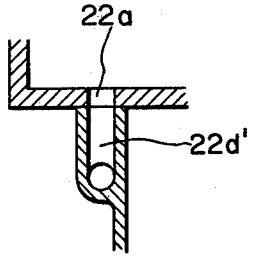
FIG. 10 is a sectional view taken along a line X—X in FIG. 8.

In a second embodiment illustrated in FIGS. 8 to 10 a by-pass canal 22*a* of a cylinder head 1 is connected with a by-pass canal 22*d*′ in a liquid pump 6′ only through a by-pass canal 22*b*′ in a cylinder case 2.

In the present invention the by-pass canal is formed within each wallthickness of the cylinder head, the cylinder and the crank case, so that the by-pass canal is formed inside of the engine body and do not extend outside of the engine body and the feature of the engine body can be elevated.

In the internal combustion engine with multicylinder it is not necessary to dispose the hose or pipe in an intricated space by mounting the carbureters and so on, so that the design of the engine can be facilitated in the present invention.

In the present invention the connection of the rubber hose and so on is unnecessary, so that the leak of the liquid can be avoided.

In the present invention the number of the parts can be decreased and the expenses can be cut down.

What is claimed is:

1. A cooling system for an internal combustion engine comprising an engine section including a cylinder head, a cylinder case and a crank case to contain a plurality of reciprocating pistons and a liquid passage for cooling the engine section by liquid flowing in the passage, said pistons being substantially vertically disposed in said engine section parallel to each other, pump means situated outside said crank case between two adjacent pistons, said pump means forcibly transmitting liquid into said liquid passage in said engine section to cool said engine section, thermostat means connected to said cylinder head above said pump means between the two adjacent pistons, said thermostat means being connected to said liquid passage in said engine section so that the liquid pumped by said pump means flows out through said thermostat means, a radiator connected between said thermostat means and said pump means to cool the liquid from the engine section and to supply the cooled liquid again to the engine section by means of said pump means, and a by-pass canal integrally formed entirely inside said engine section between said two adjacent pistons to vertically extend said engine section through said cylinder head, said cylinder case and said crank case for internally connecting said pump means and said thermostat means so that when the liquid passing through said liquid passage in the said engine section is cool, the liquid is transmitted to the pump means through said by-pass canal without passing through the radiator.

* * * * *